US007955226B2

(12) United States Patent
Dauben

(10) Patent No.: US 7,955,226 B2
(45) Date of Patent: Jun. 7, 2011

(54) DRY HEAD SWIMMING EXERCISE FLOAT

(76) Inventor: Richard D. Dauben, Newport Beach, CA (US)

( * ) Notice: Subject to any disclaimer, the term of this patent is extended or adjusted under 35 U.S.C. 154(b) by 0 days.

(21) Appl. No.: 12/589,743

(22) Filed: Oct. 28, 2009

(65) Prior Publication Data

US 2011/0098158 A1 Apr. 28, 2011

(51) Int. Cl.
*A63B 3/00* (2006.01)

(52) U.S. Cl. ..... 482/55; 441/129; D21/803

(58) Field of Classification Search ..... 482/55–56; 441/129–132, 135
See application file for complete search history.

(56) References Cited

U.S. PATENT DOCUMENTS 3,724,012 A * 4/1973 Sanderson ..... 441/55
4,837,869 A 6/1989 Simmon
4,861,300 A * 8/1989 Casagrande et al. ..... 441/81
5,050,863 A 9/1991 Yacoboski
5,307,527 A * 5/1994 Schober ..... 4/496
5,868,649 A 2/1999 Erickson et al.
5,897,409 A * 4/1999 Hartman et al. ..... 441/129
6,045,423 A * 4/2000 Silvia ..... 441/132
6,171,160 B1 * 1/2001 Skaggs et al. ..... 441/129
6,276,979 B1 8/2001 Saltel et al.
6,887,186 B2 5/2005 Bambanian
7,322,868 B2 * 1/2008 Ross ..... 441/130
7,549,706 B2 6/2009 Scheurer et al.

* cited by examiner

*Primary Examiner* — Steve R Crow

(57) ABSTRACT

An aquatic exercise device designed to elevate the head out of the water while keeping the lumbar spine slightly flexed and allowing vigorous kicking of the legs for weight loss and low impact aerobic conditioning. A swimmer swims on his back and holds onto handles, which keep the device stable and provide a secure frame while in the water. The preferred embodiment is formed from PVC pipe and polyethylene foam. The pipe components are glued together using standard PVC glue.

10 Claims, 6 Drawing Sheets

DRY HEAD SWIMMING EXERCISE FLOAT

BACKGROUND OF THE INVENTION

1. Field of the Invention

The present invention pertains generally to the field of swimming pool exercise equipment and more particularly to an apparatus which permits modest to intense pool exercise while keeping the head dry and optimizing lumbar spine flexion.

2. Background Art

Obesity and lack of exercise are common and major health problems, which lead to low back pain, joint pains in the legs, hypertension, diabetes, heart disease, stroke and a myriad of other serious medical problems. The inventor is a neurologist who has been frustrated with attempts to get patients to exercise and lose weight. Walking and cycling are often reported as aggravating back and leg pains. Swimming is an ideal form of exercise as the buoyancy of water takes the weight off the spine and legs while still allowing vigorous aerobic exercise. However, the crawl and breaststroke cause lumbar spine extension and can aggravate low back pain, and the sidestroke is not a comfortable stroke for many patients. Also, swim strokes which require the use of the arms can lead to problems with shoulder bursitis. The inventor has therefore come to frequently recommend to his patients that they swim using a backstroke and use swim fins to increase leg resistance and to allow swimming without needing to use the arms.

However, patients still often will not swim because they do not know how to swim or are poor swimmers, or do not want to get their heads wet. Women often do not want to have to reset their hair after swimming. Some patients are prone to swimmer's ear and do not want to get their ears wet. Other patients do not want to get their eyes wet, and others may have sinus problems and do not want to get water in their noses.

A search of the relevant prior art reveals the following issued U.S. Patents:

U.S. Pat. No. 4,837,869 Simmon
U.S. Pat. No. 5,050,863 Yacoboski
U.S. Pat. No. 5,307,527 Schober
U.S. Pat. No. 5,868,649 Erickson et al
U.S. Pat. No. 6,045,423 Silvia
U.S. Pat. No. 6,276,979 Saltel et al
U.S. Pat. No. 6,887,186 Bambanian
U.S. Pat. No. 7,549,706 Scheurer et al Saltel et al has no handles to stabilize the device, no headrest to keep the user's head dry and a structure which could interfere with leg motion. Silvia shows a U-shaped floating chair with a head support, but no handles to stabilize the unit and provide steering control. Bambanian shows a flexible flotation device having handles and a head support, but which provides no lower back support.

SUMMARY OF THE INVENTION

To compensate for these problems, the inventor has developed the Dry Head Swimming Exercise Float for conditioning and weight control. By adding extra flotation under the head it has been found that the head can be kept dry while swimming in all but choppy water conditions or in actual waves. Having a bar across the upper buttocks region further tilts the upper body and head upward and helps to induce slight flexion of the lumbar spine while swimming. Handles are provided at the ends of arm extensions to provide a secure frame in the water. With these features the user can swim comfortably and vigorously for prolonged periods of time without getting the head wet. If one fatigues, the device provides adequate flotation to allow the user to rest until ready to continue swimming.

The preferred embodiment uses polyethylene foam (large diameter ~3¾" and small diameter ~2⅜"), a cable tie, PVC pipe, and PVC pipe cement. The portions of the PVC pipe frame are glued together. The head pillow is attached using a cable tie. Alternative construction could use a metal frame with the pillow included in one piece of molded foam with form fitting grips at the end of the arm extensions. These alternative constructions would still need a bar or band across the low back (sacrum) or upper buttocks region to push the lower portion of the apparatus down into the water and elevate the head out of the water while still maintaining slight flexion of the lumbar spine. Small, medium, large and extra large models are envisioned to provide the proper width, length and flotation for different body sizes. Soft swim fins are highly recommended to increase swimming speed and leg resistance which allow better conditioning and faster burning of calories. Soft fins also put less stress on leg joints than harder fins.

BRIEF DESCRIPTION OF THE DRAWINGS

The aforementioned objects and advantages of the present invention, as well as additional objects and advantages thereof, will be more fully understood herein after as a result of a detailed description of a preferred embodiment when taken in conjunction with the following drawings in which.

DETAILED DESCRIPTION OF A PREFERRED EMBODIMENT

Figure 1:
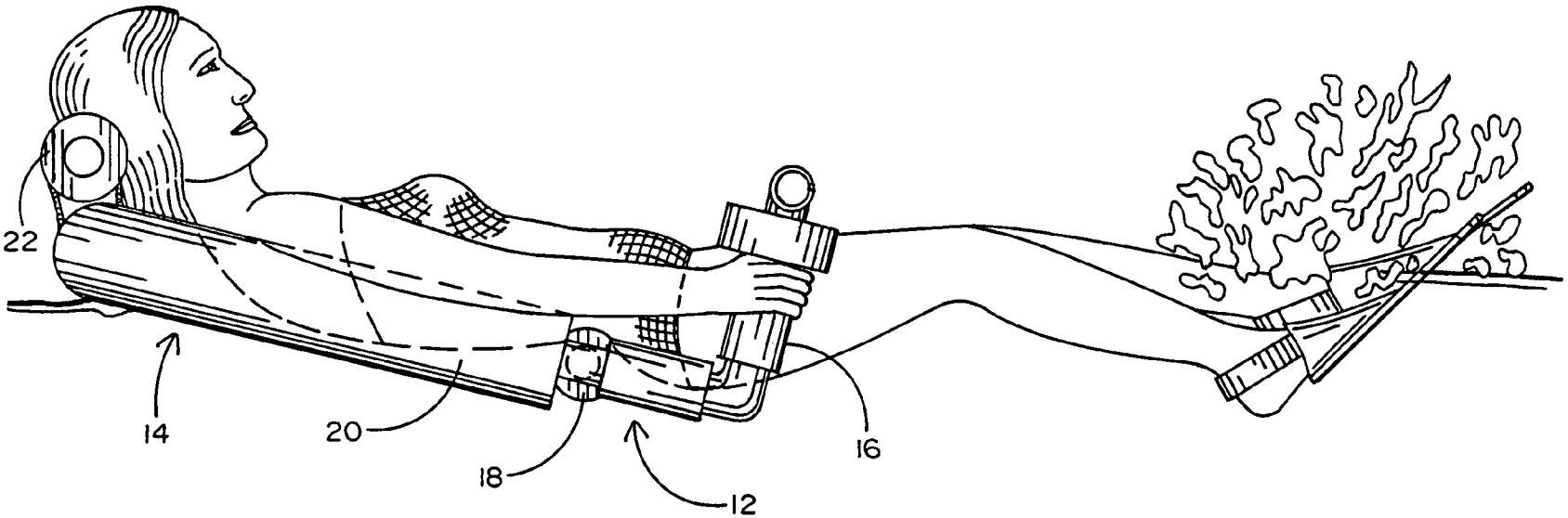
FIG. 1 is a side view of the preferred embodiment shown supporting a swimmer who is kicking in the recommended manner.
Figure 2:
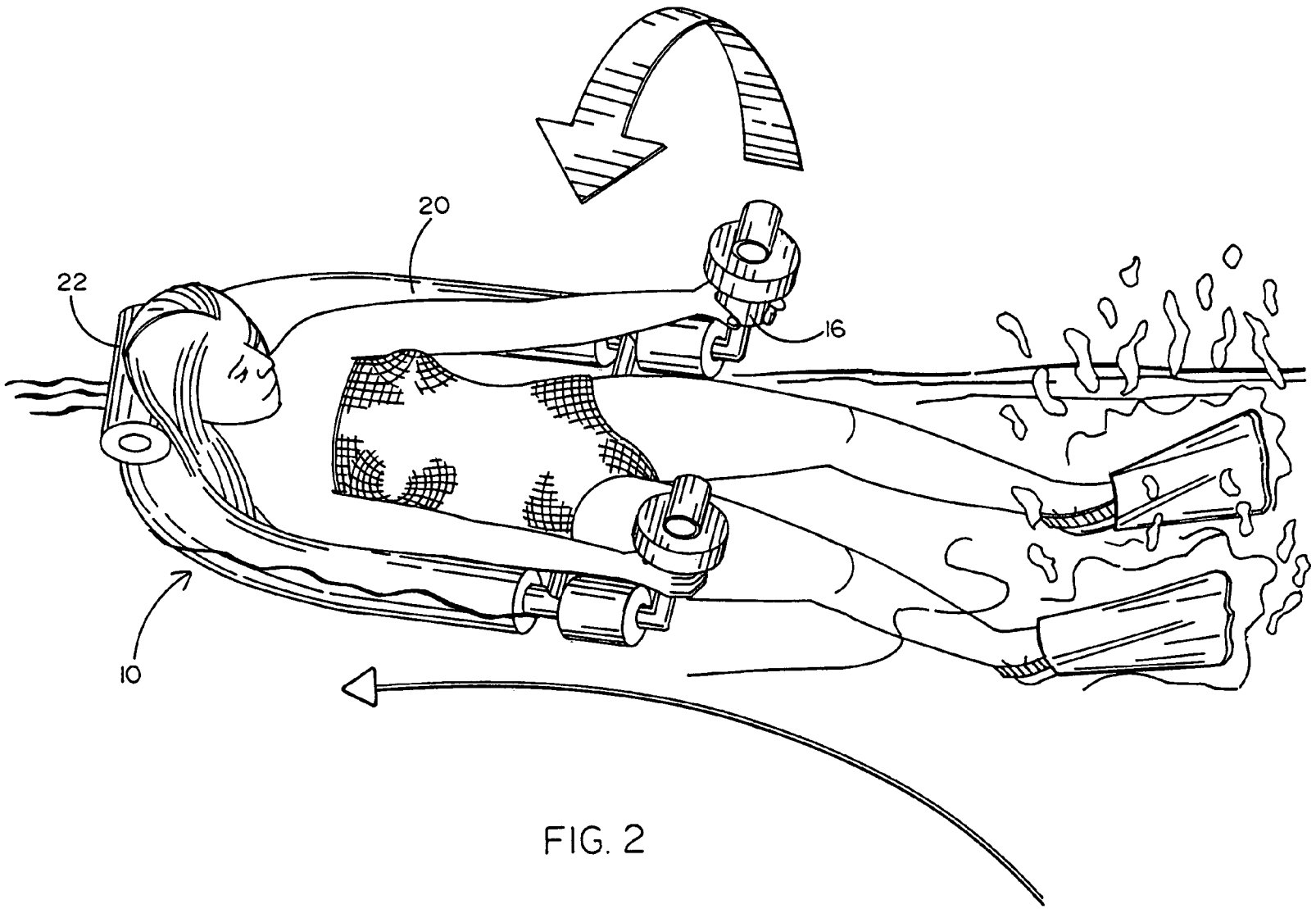
FIG. 2 is an upper view of the configuration of FIG. 1.
Figure 3:
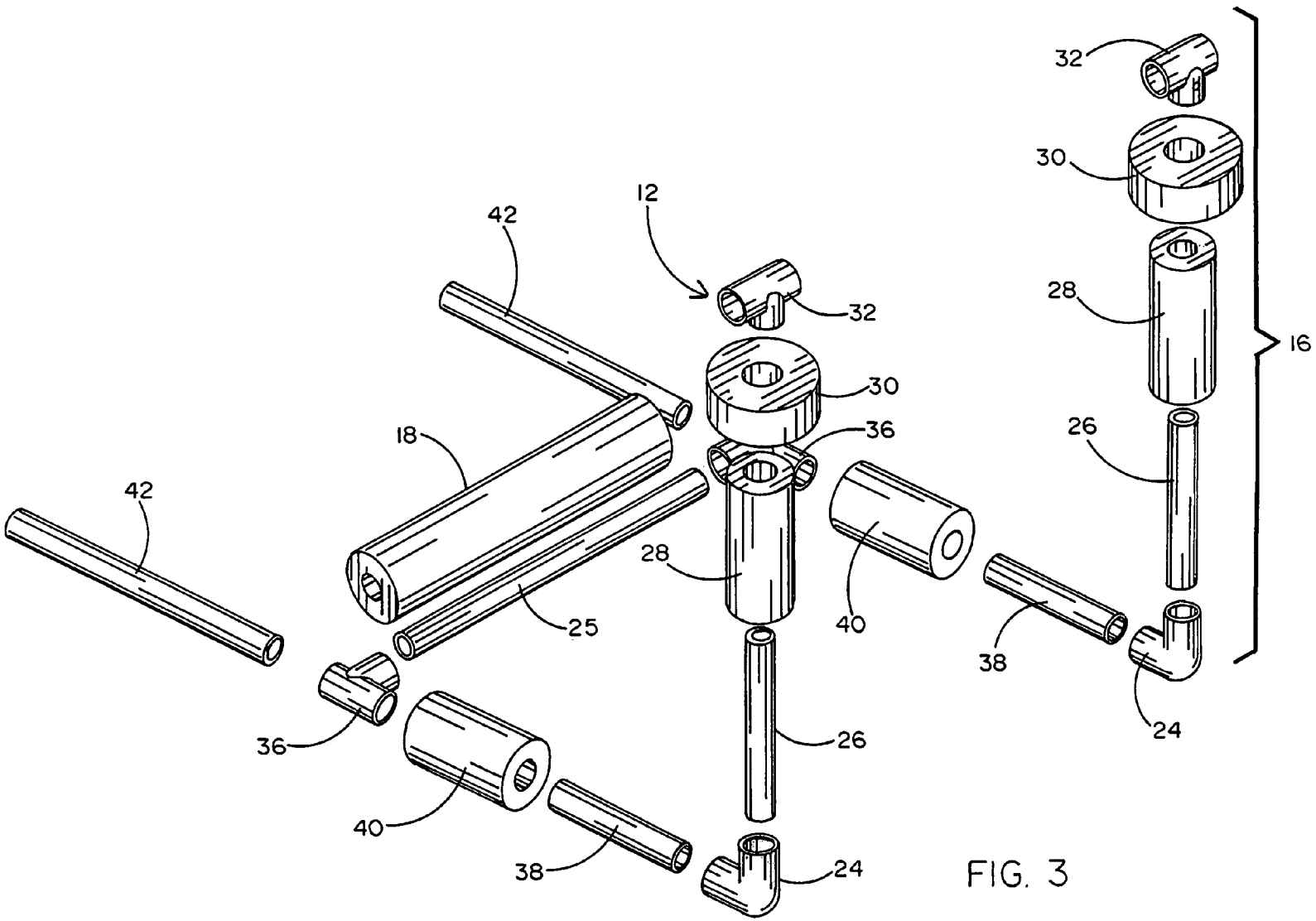
FIG. 3 is an exploded view of the lower portion of the preferred embodiment.

Referring to the accompanying drawings, it will be seen that a float apparatus 10, configured in accordance with one exemplary embodiment of the present invention, comprises a lower portion 12 and an upper portion 14. The lower portion is designed to support the lower back and provide a pair of handles 16 to permit a swimmer to stabilize and steer the apparatus 10. Moreover, as shown in FIGS. 1 and 2, the lower portion 12 is configured to permit a swimmer to extend and kick his or her legs preferably using the larger thigh, core abdominal, and back muscles to receive the benefit of the exercise of those muscles. The upper portion 14 is configured to support the swimmer's head on a foam pillow 22 in a position that is elevated above the water surface to preferably maintain dry hair as shown best in FIGS. 1 and 2. The upper portion also provides thick foam side members 20 to support the arms in a manner which allows extension of the hands down to the lower portion 12 and particularly to grasp the handle assemblies 16 thereof.

The PVC pipe components of the preferred embodiment comprise elbows 24, cross-member 25, vertical members 26, end members 32, Tee members 36 and upper extensions 42. The polyethylene components comprise back support 18, side members 20, head support pillow 22, grips 28, caps 30 and wrist members 40. Handle assemblies 16 comprise elbows 24, vertical members 26, grips 28, caps 30 and end members 32. The back support portion of the preferred embodiment comprises back support 18, cross member 25 and Tee members 36. Upper extensions 42 are attached to the Tee members 36 and extend into side members 20 which are opposed ends of a single foam member forming the upper portion 14 of the apparatus 10. A head support pillow 22 is affixed at the apogee of the upper portion by a cable tie 27.

Figure 4:
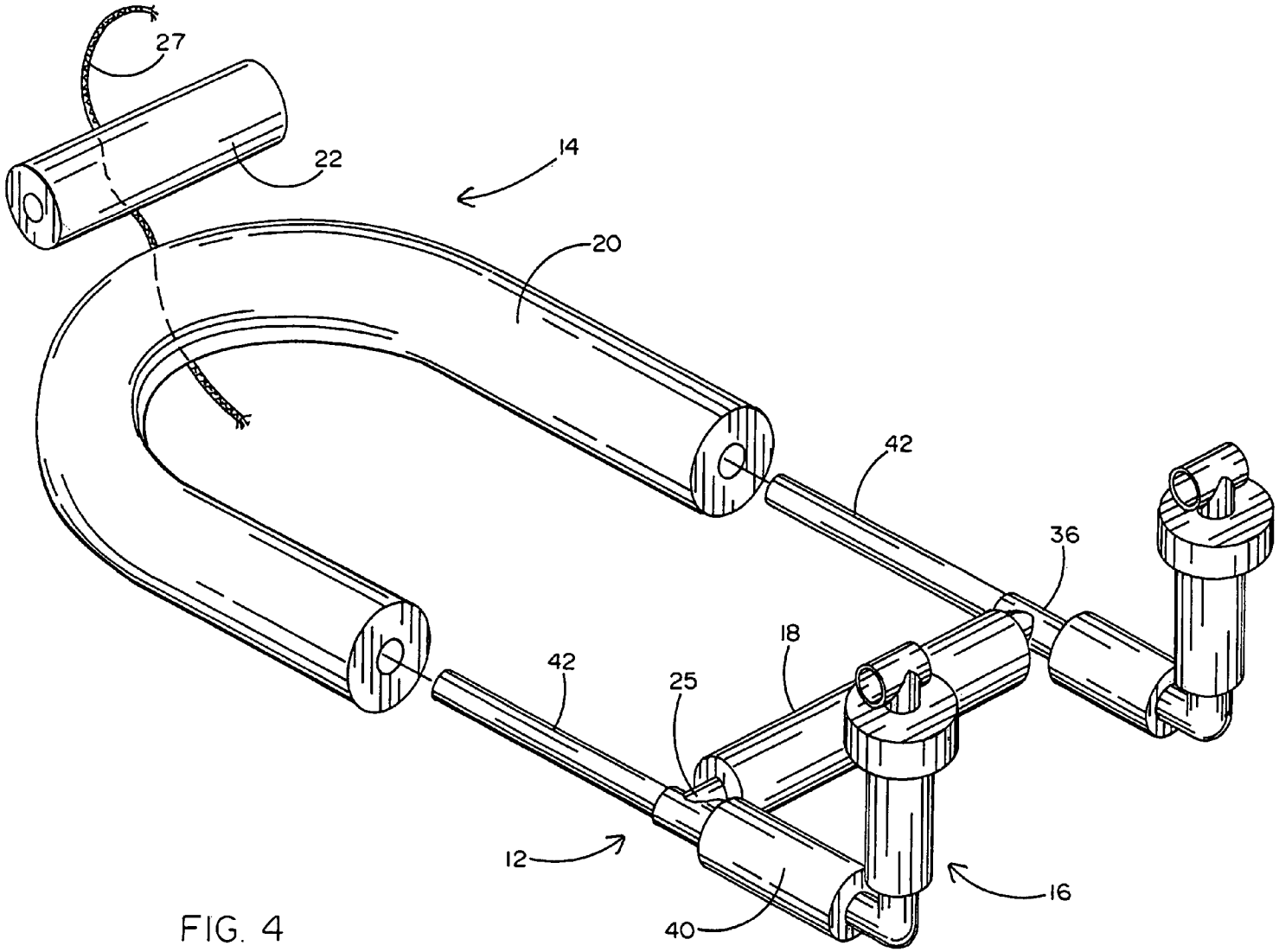
FIG. 4 adds the upper portion to the lower portion shown in FIG. 3.
Figure 5:
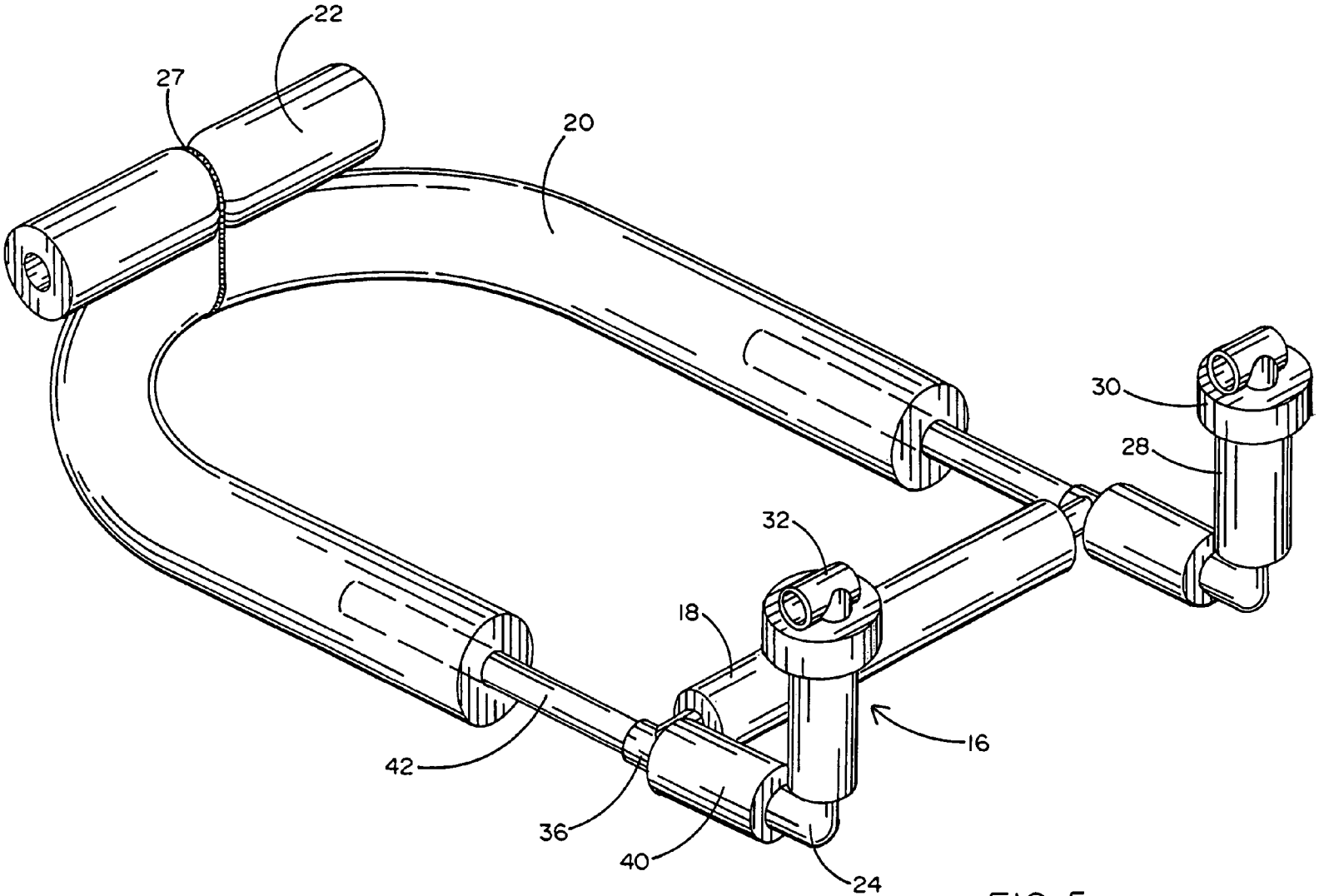
FIG. 5 is a fully assembled view of the structure of the preferred embodiment showing the relationship between PVC pipe and foam.

FIG. 4 illustrates the pre-assembled apparatus where PVC pipe cement is used to glue the PVC pipes together as well as to glue large diameter polyethylene foam to frame members 42.

Figure 6:
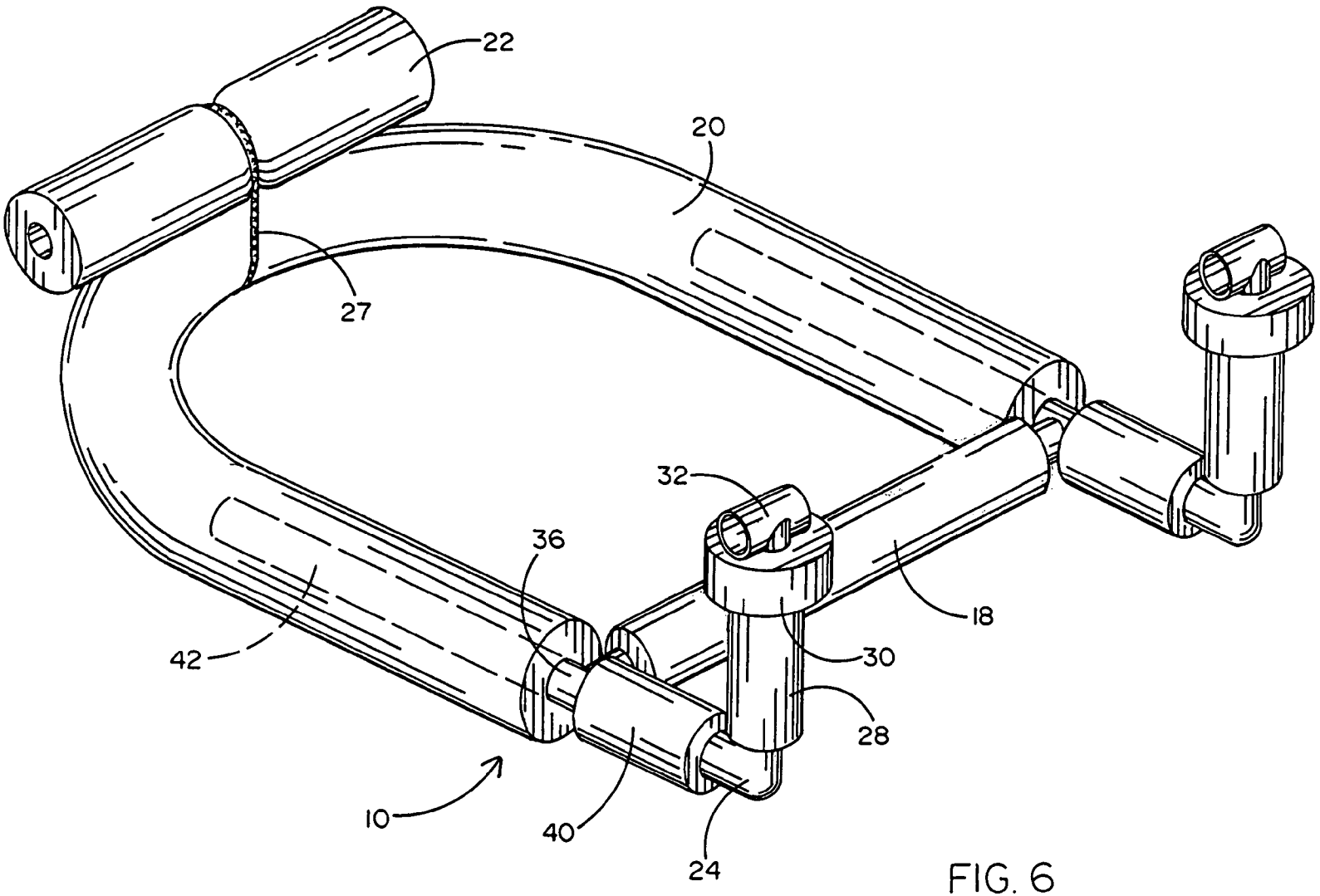
FIG. 6 is a fully assembled view as the invention would be put into use.

FIG. 6 illustrates the fully assembled apparatus 10 wherein the various components thereof are together.

FIGS. 1 and 2 illustrate the operation of the preferred embodiment of the invention. As shown therein, the swimmer is positioned on her back with her head resting against the pillow 22, her buttocks just below the back support 18 and her arms extended along side members 20 with her hands grasping grips 28 of respective handle assemblies 16. As further shown in FIGS. 1 and 2, the swimmer may readily control and steer the apparatus 10 using her legs and feet for propulsion and her hands for stabilization and orientation. More significantly, the swimmer's head remains relatively dry above the water surface, her back is supported and in a slight flexion position to reduce lumbar strain and her legs are free to kick using her larger thigh, abdominal and back muscles for maximum exercise benefit. The addition of the polyethylene foam caps 30 just above the foam grips 28 have been found to allow more relaxed and secure gripping of the frame.

It will now be understood that what has been disclosed herein is a novel and advantageous exercise float apparatus that is highly beneficial as a tool for encouraging weight loss and conditioning by exercise in a safe and pleasant environment, a swimming pool. Although a preferred embodiment has been disclosed herein, it will be understood that variations and improvements are contemplated. Therefore, the scope hereof is not limited by the disclosed exemplary embodiment, but instead by the claims appended hereto and their legal equivalents.

I claim:

1. A swimming exercise float apparatus for supporting a swimmer in a supine position to permit vigorous kicking exercise while keeping the head elevated out of the water and the lumbar spine in a slightly flexed position; the apparatus comprising:

a buoyant swimmer support frame having a head support at a first end and a back support at a second end:

said support frame comprising a U-shaped section;

an H-shaped section having proximal ends which can telescope with said U-shaped section for adjustment purposes, a central transverse lumbar support, and a pair of handles extending from the distal ends; and said head support being configured for supporting a swimmer's head out of the water face up and raised above the frame, the back support providing a lumbar support surface that permits vigorous kicking exercise while maintaining a slight flex of the lumbar spine.

2. The apparatus recited in claim 1 wherein said support frame is made of pipes enclosed by foam cushion material.

3. The apparatus recited in claim 1 wherein said support frame is made of PVC pipes enclosed by polyethylene foam material.

4. The apparatus recited in claim 1 wherein said pair of handles are comprised of PVC pipes enclosed by polyethylene foam material.

5. The apparatus recited in claim 1 wherein said head support is secured to said first end of said support frame by a cable tie.

6. The apparatus recited in claim 1 wherein said back support is positioned in said support frame to be just above a swimmer's buttocks when the swimmer's head is in contact with said head support.

7. The apparatus recited in claim 1 wherein said pair of handles extend perpendicularly from said second end of said support frame.

8. The apparatus recited in claim 1 wherein said frame comprises plastic pipes that are glued together.

9. An exercise apparatus for use by a swimmer in a body of water wherein the swimmer is supported in a supine position with the legs free to kick for vigorously exercising large thigh and core abdominal and back muscles, the apparatus comprising:

a U-shaped section having a raised head support;

an H-shaped section having proximal ends which can telescope with said U-shaped section for adjustment purposes, a central transverse lumbar support, and a pair of handles extending from the distal ends;

the apparatus being formed from a plurality of interconnected pipe components enclosed by a foam material; the head support for supporting the head face up and the lumbar support permitting vigorous kicking exercise with a slight flex of the lumbar spine.

10. The apparatus recited in claim 9 wherein said pipe components are made of polyvinyl chloride plastic and said foam material is made of polyethylene.

* * * * *